US005297294A

United States Patent [19]

Washick

[11] Patent Number: 5,297,294

[45] Date of Patent: Mar. 29, 1994

[54] SHIN GUARD HAVING KNEESHIELD, ACCORDIAN PLEATED FLEXURE AREA, FLEXURE GROOVES AND VENTILATION APERTURES

[76] Inventor: Steven R. Washick, 7834 Corey Path, Inver Grove Heights, Minn. 55076-3129

[21] Appl. No.: 31,703

[22] Filed: Mar. 15, 1993

[51] Int. Cl.[5] ..... A41D 13/00

[52] U.S. Cl. ..... 2/22; 2/2; 2/24; 602/5; 602/16

[58] Field of Search ..... 2/22, 2, 24; 602/5, 602/6, 12, 14, 16, 23, 26, 60, 62, 63

[56] References Cited

U.S. PATENT DOCUMENTS

| | | | |
|---|---|---|---|
| 909,215 | 1/1909 | Pierce et al. | 2/22 |
| 2,640,989 | 6/1953 | Woodward | 2/22 |
| 2,785,407 | 3/1957 | Reeder | 2/22 |
| 2,982,968 | 5/1961 | Groot | 2/22 |
| 3,772,704 | 11/1973 | Carbonneau | 2/22 |
| 3,898,697 | 8/1975 | Whitehead | 2/22 |
| 4,674,157 | 6/1987 | Litz | 2/22 |
| 5,107,823 | 4/1992 | Fratesi | 2/22 |

*Primary Examiner*—Clifford D. Crowder
*Assistant Examiner*—Gloria Hale
*Attorney, Agent, or Firm*—Leon Gilden

[57] ABSTRACT

A shin guard having a lowermost web of a generally U-shaped channel configuration is arranged for flexure about an individual's shin portion, with an associated knee guard mounted hingedly relative to a first end of the web. Parallel grooves directed through the web permits the ease of flexure of the web relative to the shin, wherein the grooves include ventilation apertures, with the positioning of the ventilation apertures within the grooves affording protection to the apertures in use.

1 Claim, 4 Drawing Sheets

SHIN GUARD HAVING KNEESHIELD, ACCORDIAN PLEATED FLEXURE AREA, FLEXURE GROOVES AND VENTILATION APERTURES

BACKGROUND OF THE INVENTION

1. Field of the Invention

The field of invention relates to shin guard structure, and more particularly pertains to a new and improved shin guard wherein the same is arranged to afford protection to an individual's shin and knee portions in a sporting event.

2. Description of the Prior Art

Shin guard structure is available in the prior art and exemplified by the U.S. Pat. No. 4,700,406 to Meistrell wherein a shin guard includes an associated knee portion interconnected by a connecting relationship.

U.S. Pat. No. 4,893,355 to Ritter is an example of a prior art knee protector.

The instant invention attempts to overcome deficiencies of the prior art by providing for a shin guard arranged for ease of flexure and accommodation of an individual's shin and knee portion and in this respect, the present invention substantially fulfills this need.

SUMMARY OF THE INVENTION

In view of the foregoing disadvantages inherent in the known types of shin guard now present in the prior art, the present invention provides a shin guard wherein the same is directed to the physiological accommodation of an individual's shin and knee portions in use. As such, the general purpose of the present invention, which will be described subsequently in greater detail, is to provide a new and improved shin guard which has all advantages of the prior art shin guards and none of the disadvantages.

To attain this, the present invention provides a shin guard having a lowermost web of a generally U-shaped channel configuration arranged for flexure about an individual's shin portion, with an associated knee guard mounted hingedly relative to a first end of the web. Parallel grooves directed through the web permits the ease of flexure of the web relative to the shin, wherein the grooves include ventilation apertures, with the positioning of the ventilation apertures within the grooves affording protection to the apertures in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shin guard which has all the advantages of the prior art shin guards and none of the disadvantages.

It is another object of the present invention to provide a new and improved shin guard which may be easily and efficiently manufactured and marketed.

It is a further object of the present invention to provide a new and improved shin guard which is of a durable and reliable construction.

An even further object of the present invention is to provide a new and improved shin guard which is susceptible of a low cost of manufacture with regard to both materials and labor, and which accordingly is then susceptible of low prices of sale to the consuming public, thereby making such shin guards economically available to the buying public.

Still yet another object of the present invention is to provide a new and improved shin guard which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
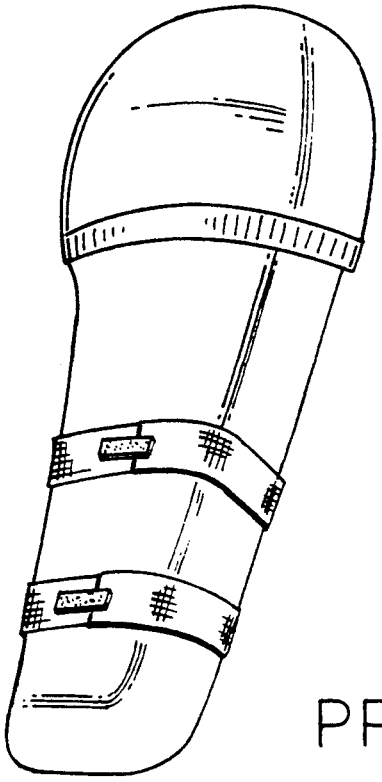
FIG. 1 PRIOR ART
FIG. 1 is an isometric illustration of a prior art shin and knee guard structure, as indicated in U.S. Pat. No. 4,700,406.
Figure 2:
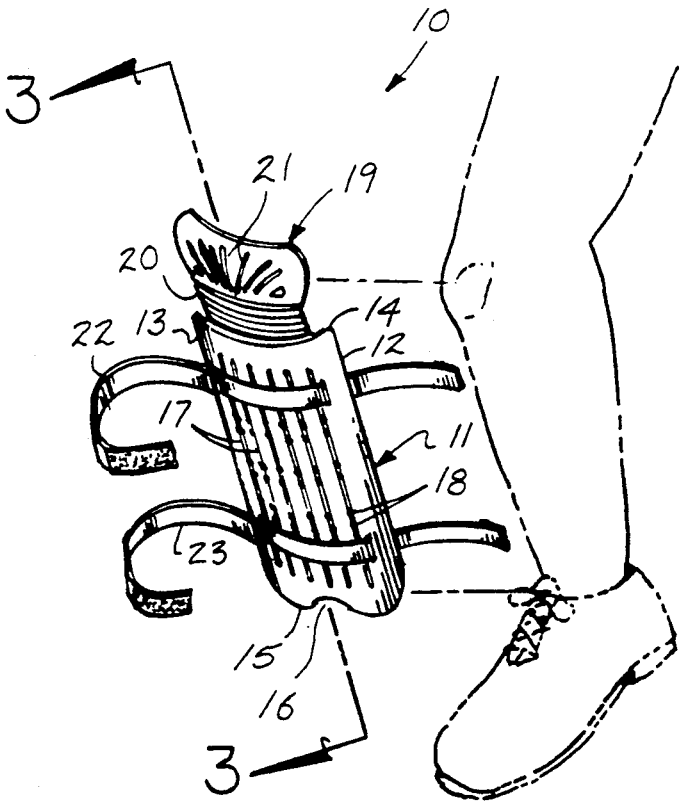
FIG. 2 is an isometric illustration of the invention.
Figure 3:
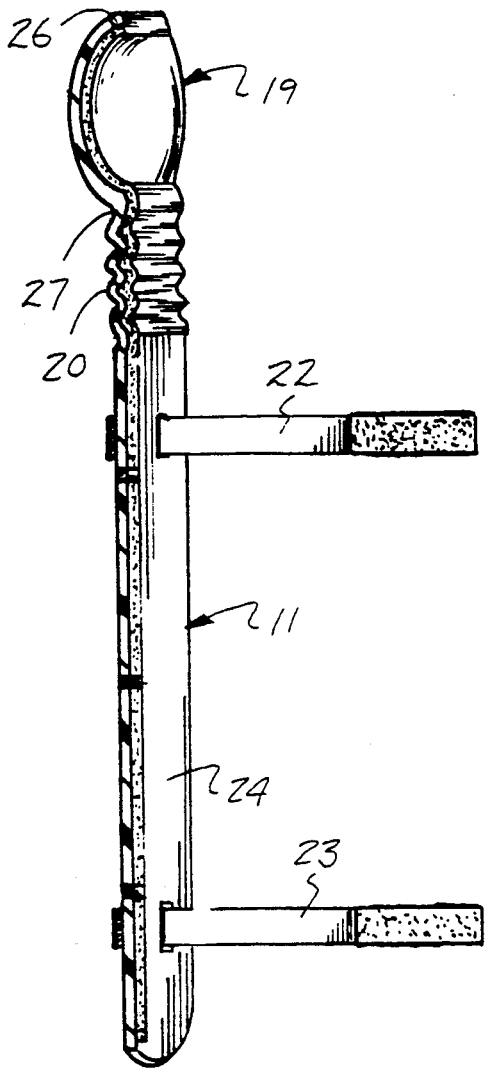
FIG. 3 is an orthographic view, taken along the lines 3—3 of FIG. 2 in the direction indicated by the arrows.
Figure 4:
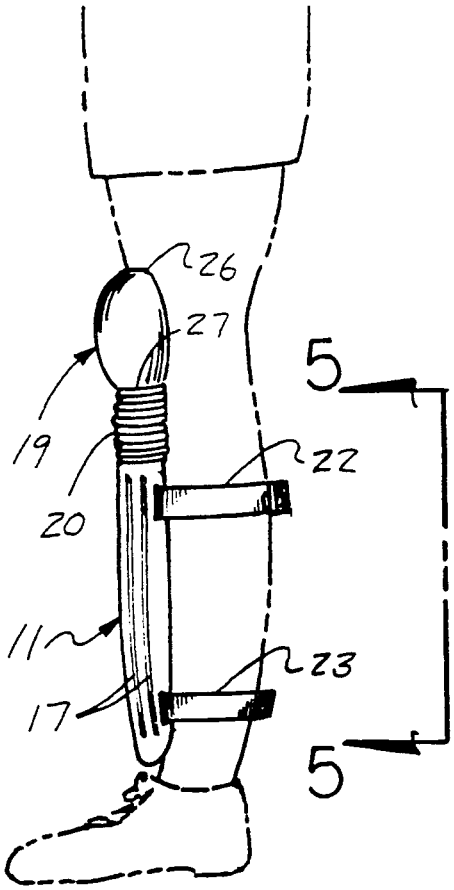
FIG. 4 is an orthographic side view of the invention mounted to an individual's shin and knee portions.
Figure 5:
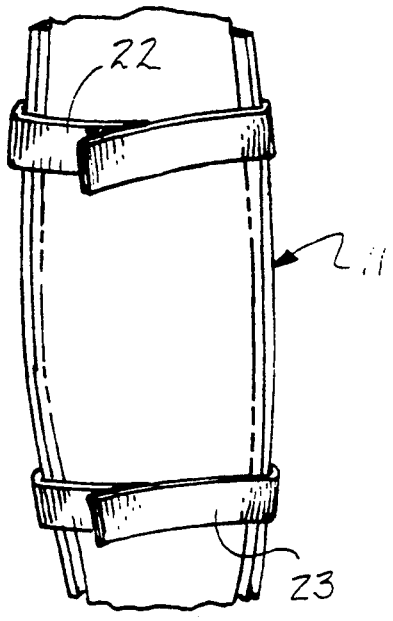
FIG. 5 is an orthographic view, taken along the lines 5—5 of FIG. 4 in the direction indicated by the arrows.
Figure 6:
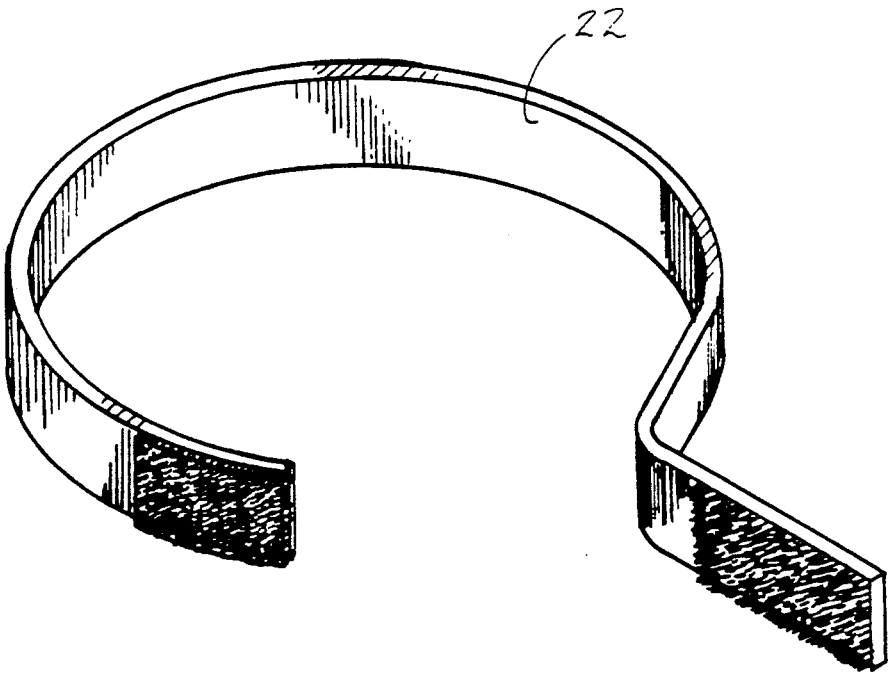
FIG. 6 is an isometric illustration of a strap structure employed by the invention.

With reference now to the drawings, and in particular to FIGS. 1 to 7 thereof, a new and improved shin guard embodying the principles and concepts of the present invention and generally designated by the reference numerals 10 and 10*a* will be described.

More specifically, the shin guard 10 of the instant invention essentially comprises a deformable web 11 of a semi-rigid construction of a generally U-shaped configuration and formed of a shape retentive material. The web includes a convex exterior surface coextensive with a concave interior surface, and a web first side 12 spaced from a web second side 13, a web first end 14 spaced from a web second end 15. The web second end includes a second end central recess 16 arranged to accommodate an individual's foot portion therewithin during movement of the foot relative to the shin guard structure, and more specifically, relative to the second end 15. A plurality of parallel grooves 17 are spaced an equal distance relative to one another and oriented between and parallel relative to the web first and second ends 12 and 13. Within each of the parallel grooves 17 are a plurality of ventilation apertures 18. Orientation of the apertures 18 within the grooves afford protection to the apertures during use of the shin guard structure relative to impact and directing of debris onto the concave exterior surface of the web 11. A rigid knee shield 19 is provided, having a knee shield first end spaced from a knee shield second end 26 and 27 respectively (see FIG. 7). The knee shield second end 27 is an accordion pleated plurality of parallel ribs 20 of an arcuate configuration extending from the second end to the web first end 14. Pivoting and rotation of the knee shield relative to the web 11 is thusly afforded. Further, a radial array of knee shield grooves 21 extend medially of the knee shield second end 27 towards the knee shield first end 26. The knee shield grooves 21 enhance flexure if required to the rigid knee shield 19 upon impact to the knee shield thusly minimizing shattering of the knee shield upon impact.

First and second straps 22 and 23 extend orthogonally relative to the web first and second sides 12 and 13 and include respective first and second strap hook and loop fastener ends to the distal ends of the first and second straps 22 and 23 respectively permitting securement of the web 11 about an individual's shin portion. A foam cushion layer 24 (see FIG. 3) extends coextensively to the web and the knee shield interior concave surface.

Figure 7:
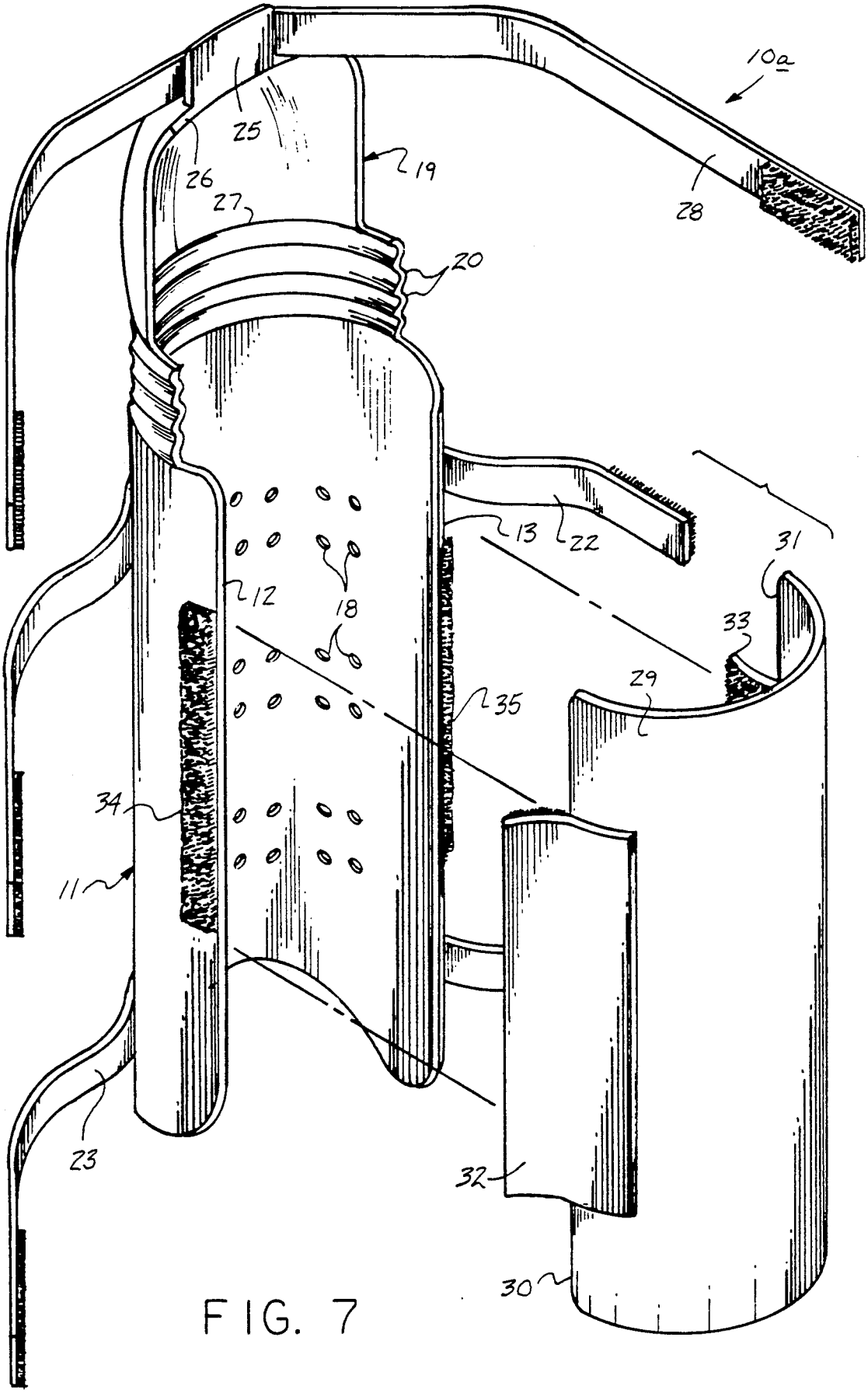
FIG. 7 is an isometric illustration of a modified shin guard structure employing a surrounding protective cover.

A modified shin guard 10*a*, as indicated in FIG. 7, includes a lug 25 mounted medially of the knee shield first end 26 mounting a third strap 28 having third strap hook and loop fastener ends permitting securement about an individual's shin portion. Further, if required for enclosed protection to the individual's lower limb, a U-shaped calf cover shield 29 is provided having a cover shield first side 30 spaced from a cover shield second side 31, including respective first and second hook and loop fastener webs 32 and 33 mounted to the cover shield first and second sides cooperative with web first and second side hook and loop fastener strips 34 and 35 mounted to the web first and second sides 12 and 13 permitting ease of securement of the calf cover shield 29 in an abutting relationship to the web 11 along the first and second sides of the cover shield and arranged to abut the first and second sides of the web, as illustrated in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shin guard, comprising, a deformable U-shaped channel web formed of a shape retentive material, including a web convex exterior surface and a web concave interior surface, with the web having a web first side spaced from a web second side, a web first end spaced from a web second end, and a web second end central recess directed into the second end to accommodate an individual's foot therewithin, and a rigid knee shield, the knee shield having a shield convex exterior surface and a shield concave interior surface, and a shield first end and a shield second end, with the shield second end spaced from and in adjacency to the web first end, and a plurality of accordion pleated ribs extending between the shield second end and the web first end permitting pivoting and rotation of the shield relative to the web, and the web includes a plurality of spaced parallel grooves extending between the web first side and the web second side, wherein the grooves are arranged parallel relative to one another and to the web first side and the web second side, and within each of the grooves is a plurality of ventilation apertures affording protection to the ventilation apertures in use of the web, and the shield includes a radial array of shield grooves extending from the shield second end in a splayed orientation relative to the shield first end, and a first strap and a second strap arranged in a parallel relationship relative to one another and directed through the web, wherein the first strap includes first strap first end fasteners and the second strap includes second strap fasteners, with the first strap fasteners and the second strap fasteners permitting securement of the first strap and the second strap for an individual's lower limb portion, and the web concave interior surface and the shield concave interior surface and the accordion pleated ribs include a unitary form cushion layer extending from the web second end to the shield first end, and extending between the web first side and the web second side, and the shield first end includes a lug fixedly mounted to the shield first end medially thereof, and a third strap is mounted to the lug, wherein the third strap includes third fasteners permitting securement of the shield relative to an individual's knee portion in a surrounding relationship, and a U-shaped calf cover shield, the cover shield having a cover shield first side and a cover shield second side, with the cover shield first side arranged for contiguous and coextensive communication with the web first side, and the cover shield second side including contiguous and coextensive relationship relative to the web second side, and the cover shield first side including a first side hook and loop fastener web, and the cover shield second side including a second side hook and loop fastener web, and the web having a web first side hook and loop fastener strip mounted to the web convex exterior surface in adjacency to the web first side for securement to the first side hook and loop fastener web, and the web including a web second side hook and loop fastener strip mounted to the web convex exterior surface in adjacency to the web second side for securement to the second side hook and loop fastener web.

* * * * *